US006325543B1

(12) United States Patent
Ausnit

(10) Patent No.: US 6,325,543 B1
(45) **Date of Patent: *Dec. 4, 2001**

(54) GUSSETED ZIPPER BAG

(75) Inventor: Steven Ausnit, New York, NY (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/645,828

(22) Filed: Aug. 25, 2000

(51) Int. Cl.[7] ..... B65D 33/16

(52) U.S. Cl. ..... 383/210; 383/61; 383/63; 383/120

(58) Field of Search ..... 383/63, 120, 210, 383/61, 906

(56) References Cited

U.S. PATENT DOCUMENTS 2,929,123 * 3/1960 Schneideman ..... 383/64 X
4,997,104 * 3/1991 Pohl ..... 383/43 X
5,037,138 * 8/1991 McClintock et al. ..... 383/43 X
5,692,837 * 12/1997 Beer ..... 383/61
5,941,643 * 8/1999 Linkiewicz ..... 383/63 X
6,030,123 * 2/2000 Mitarai ..... 383/63
6,132,089 * 10/2000 Galomb et al. ..... 383/61 X
6,164,826 * 12/2000 Petkovsek ..... 383/63 X
6,186,663 * 2/2001 Ausnit ..... 383/63

* cited by examiner

*Primary Examiner*—Jes F. Pascua
(74) *Attorney, Agent, or Firm*—Piteny, Hardin, Kipp & Szuch LLP

(57) ABSTRACT

A zipper bag contains interlocking profiles on the front and rear walls of the bag. The bag further has gusseted side walls that include portions aligned with the interlocking profiles that are relatively thin as compared with the remainder of the bag walls. The thinned sections may be profile-free portions of a carrier web for the profiles. Windows are cut out of the sidewalls and covered by the profile free sections of the carrier web.

7 Claims, 3 Drawing Sheets

GUSSETED ZIPPER BAG

BACKGROUND OF THE INVENTION

1. Field of the Invention

The present invention relates to gusseted reclosable plastic bags and, in particular to zipper bags made of barrier films, wherein the gusset can be fully opened and the zipper can fully close the bag 2. Prior Art Heretofore reclosable plastic bags have been provided with gusseted sides. An advantage of such gusseted bags is that they may be opened more fully to facilitate filling and emptying or the gusset may be inverted to form a pouring spout.

In previous concepts for such bags, the profiles of the zipper had to be sufficiently large to capture a double thickness of the bag film in order to accommodate the gussets. This results in a construction that was generally not acceptable in applications where barrier films were required. The problem becomes more acute the more complex the film and hence, the thicker the bag walls

SUMMARY OF THE INVENTION

In view of the above, it is a principal object of the present invention to provide an improved gusseted zipper bag, wherein the bag wall thickness will not prevent the zipper profiles from capturing a portion of the gusset.

A further object is to provide a gusset bag which may readily be formed to have one gusset open as a spout.

The above and other objects and advantages are attained in accordance with the present invention by providing a bag having front and rear walls and gusseted side walls. Mating zipper profiles are provided on the front and rear walls respectively and a thinned wall section is provided in the gusset portions aligned with the zipper profiles. The thinned gusset wall portions may be provided in different manners. The portions of the bag film material forming the gussets may be physically thinned in the areas aligned with the profiles. Alternatively, windows may be cut in the plastic film material of the gussets in the areas aligned with the profiles, with the windows, in turn, being covered by thin film segments. The gusset windows may be covered by separate strips of thin film which is free of profiles. Alternatively, the zipper profiles may be provided on a thin carrier strip wherein segments of profiles are separated from each other by a distance equal to that of the length of the windows. The carrier strip may then be attached to the bag wall, with the profile free portions of the strip covering the window openings. The gussets may be open at both opposite ends of the bag or may be sealed together at one end to provide a spout at the opposite end.

DETAILED DESCRIPTION OF THE PREFERRED EMBODIMENTS

Figure 1:
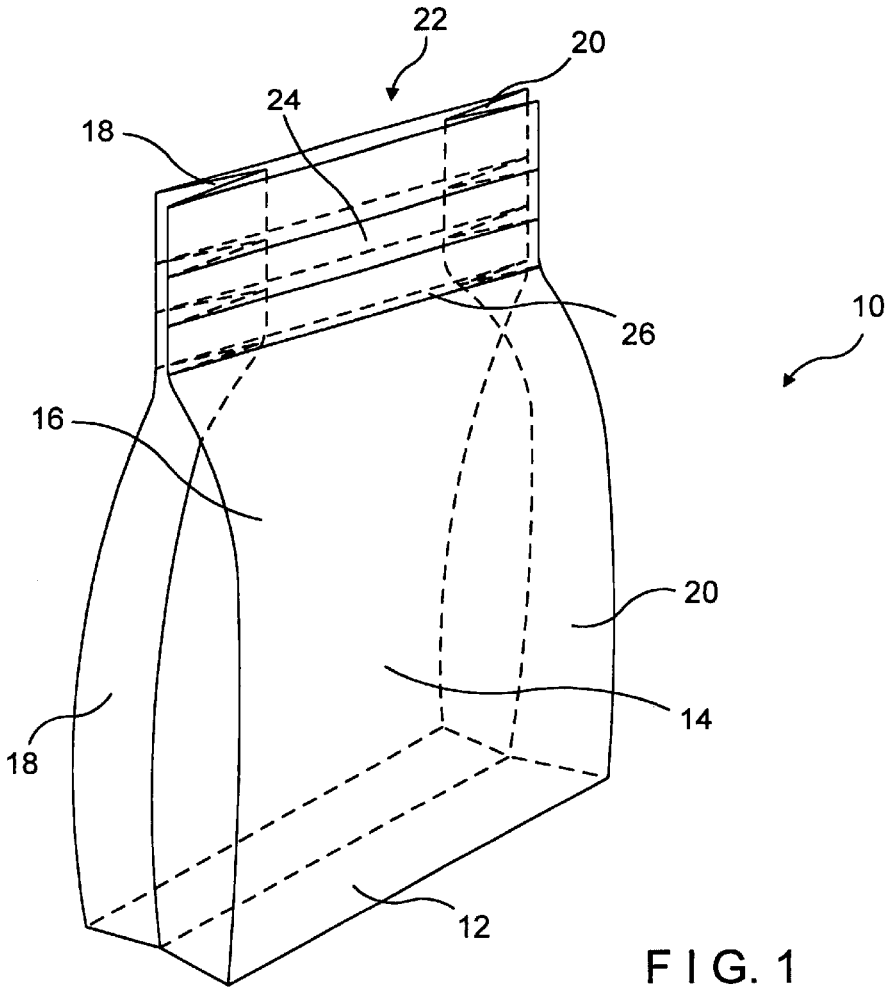
FIG. 1 is a perspective view of a gusseted bag in accordance with the present invention.

Reference is now made the drawings and to FIG. 1 in particular wherein a gusseted bag 10 in accordance with the present invention is depicted comprising a bottom 12 (which may or may not be gusseted), a front wall 14, rear wall 16 and gusseted side walls 18 and 20. The top end 22 of the bag is open and closed by a zipper 24. A peel seal 26 may be provided below (or above) the zipper to provide pilfer evidence and/or to permit hermetic sealing.

Figure 2:
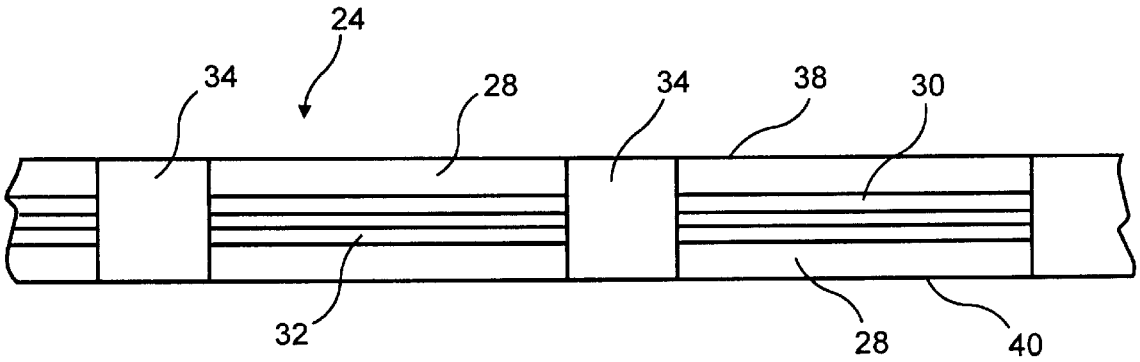
FIG. 2 is a top plan view of a partially zippered carrier strip used in forming the bag of FIG. 1.

Zipper sections 24 are attached on a carrier web whose construction is depicted in FIG. 2 and consists of a carrier web 28 upon which sections of zipper with profiles 30, 32 are laid out between profile-free zones 34. The profiles 30, 32 may be male and female profiles or both may be unisex. What is important is that profile section 30 be capable of interlocking with profile section 32. The carrier web 28 is formed of plastic film that is relatively thin with respect to the walls of the bag so as to enable the profile-free zones to be readily captured between portions of the profiles 30, 32 when interlocked.

Figure 3:
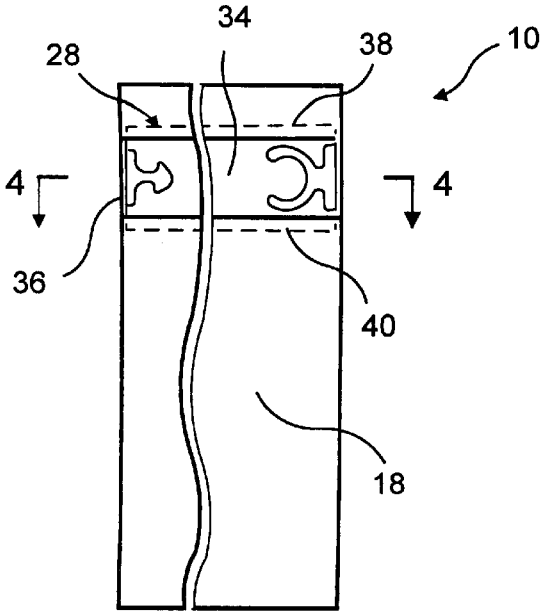
FIG. 3 is a side elevation view of the bag of FIG. 1 with the gusseted area open.
Figure 4:
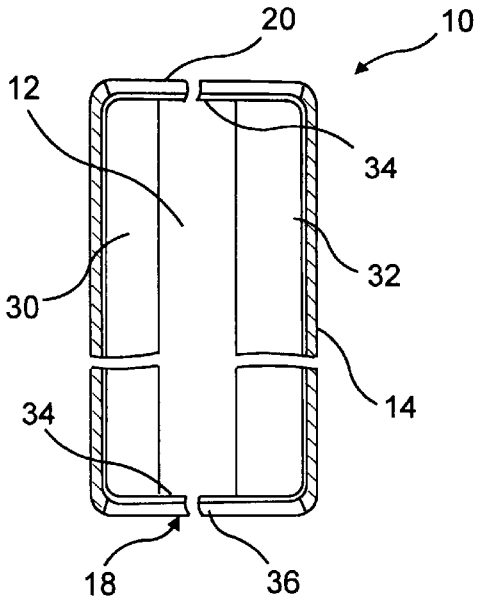
FIG. 4 is a sectional view taken along reference lines 4—4 of FIG. 3.

Reference is now made to FIGS. 3 and 4 wherein the zipper and carrier web 28 is depicted in position on the bag body. Referring to FIG. 3, a side 18 of the bag 10 is depicted with the gusset fully open. As can be seen, a window 36 is cut in each of the side walls extending from edge to edge of the respective sides. The edges 38, 40 of the zipper and carrier web 28 are sealed about the bag so that window 36 of one side wall is covered by one zipper profile free portion 34 of the carrier web 28 and the opposite side wall is covered by the next profile-free portion 34. The top and bottom marginal portions 38, 40 of the carrier web 28 are also sealed to the front and rear walls of the bag so that one of the zippers with profile portions 30 of the zipper carrier web extends along the interior of the front wall and the other of the zippers with profile portions 32 of the zipper carrier web extends across the rear wall. The zipper profile free portions 34 of the carrier web extend across the gusset side walls 18, 20 in line with the profiles and cover the windows 36 and 40 cut outs of the gusset side walls.

Figure 5:
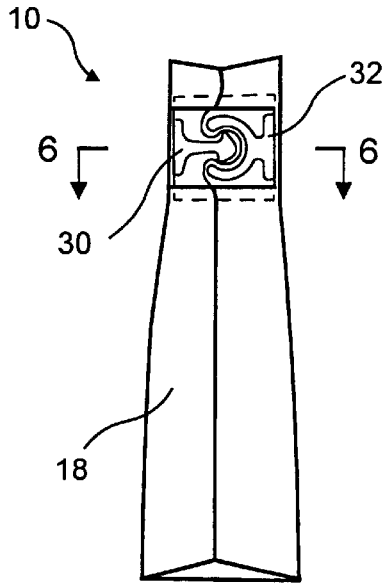
FIG. 5 is a side elevation view of the bag of FIG. 1 with the gusseted area closed.
Figure 6:
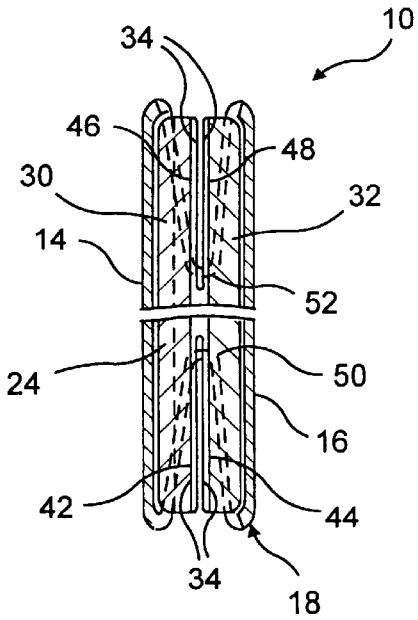
FIG. 6 is a sectional view taken along reference lines 6—6 of FIG. 5.
Figure 7:
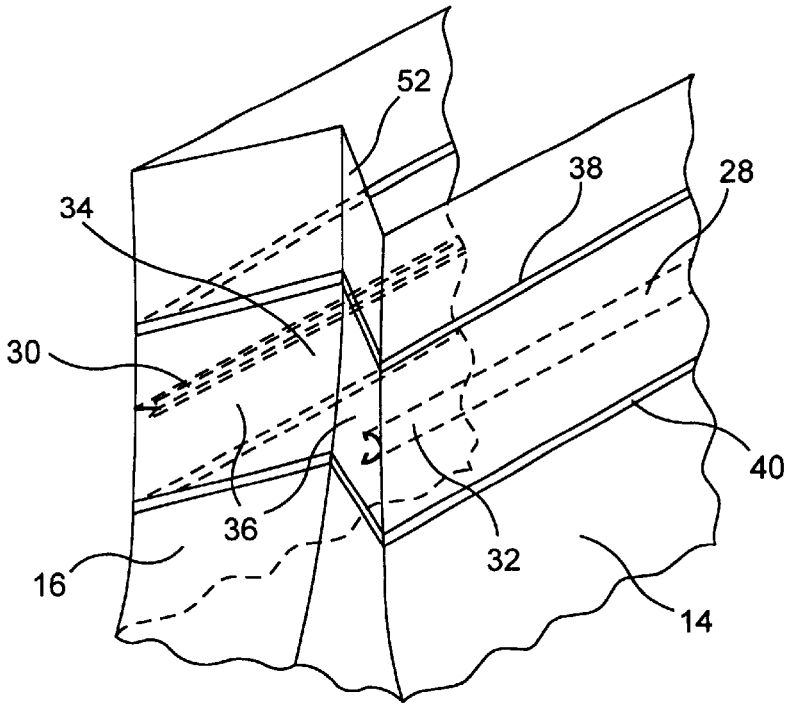
FIG. 7 is a fragmentary perspective view of the bag of the present invention with a side gusset partially closed.
Figure 8:
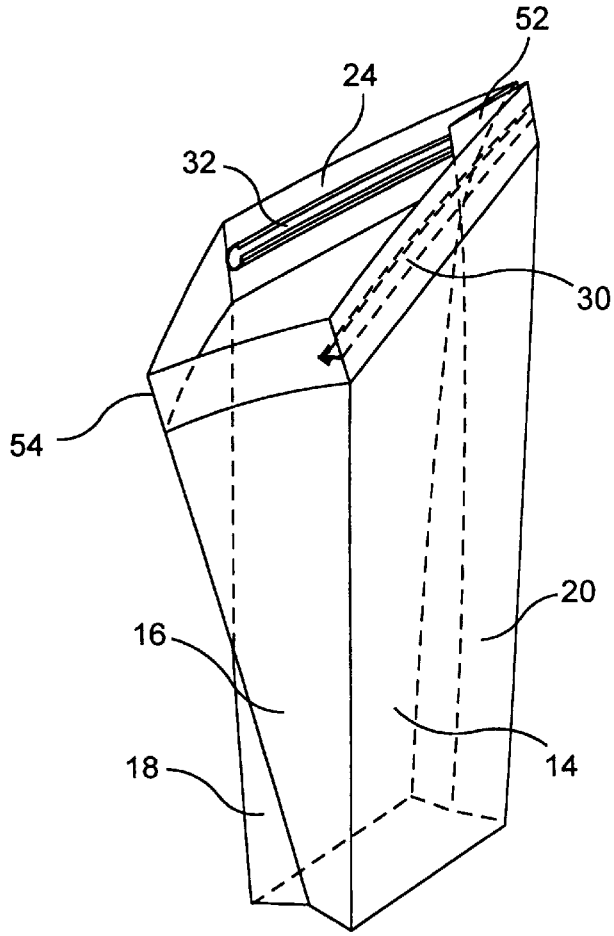
FIG. 8 is a perspective view of the gusset bag of the present invention wherein the top of one of the gusseted sides is sealed and the opposite side is inverted to form a funnel.

Referring to FIGS. 5, 6 and 7 it can be seen that as the gusseted side walls are closed, by folding the gussets inward about the gusset folds 50, 52, the profile free portions 34 of the carrier web are captured between the zipper profiles 30, 32 at their ends 42, 44 and 46, 48. Since the carrier web is relatively thin with respect to the remainder of the bag walls, the gusseted sides are accommodated within the interlocked profiles with relative ease. If desired, after capturing one of the profile free areas of the carrier strip within the associated profiles, as discussed above, the front 14 and rear 16 walls of the bag may be sealed to one another through the profiles and profile free area of the gusset side wall 20 at a side seal 52. The gusset at the other side 18 may then be fully opened and inverted, as shown in FIG. 8 to form a convenient pour spout 54 for the bag.

Thus, in accordance with the above, the aforementioned objects may be effectively attained. The several embodiments disclosed herein are for illustration purposes, it being understood that many variations are possible within the scope of the appended claims. Having thus described the invention, what is claimed now follows.

What is claimed is:

1. A reclosable plastic bag comprising:

a front wall;

a rear wall; and gusseted side walls on opposite sides of said bag interconnecting said front and rear walls;

first and second interlocking zipper profiles extending between said side walls respectively positioned below the tops of said front and rear walls;

each of said gusseted side walls comprising a major section having a first thickness substantially the same as that of said front and rear walls and a minor section having a thickness less than said first thickness, said minor sections extending on said side walls between said front and rear walls and being aligned with said interlocking profiles whereby when said gussets are collapsed, portions of said gusseted walls' minor sections are captured between said interlocking profiles.

2. The bag in accordance with claim 1 wherein portions of said bag side walls are cut out to form window openings extending between said front and rear walls, said window openings being covered by a carrier web of film material, said film material defining said minor sections of said gusseted walls.

3. The bag in accordance with claim 2 wherein said carrier web further includes sections attached to said bag front and rear walls and said first and second profiles are affixed respectively to said carrier web portions affixed to said front and rear walls.

4. The bag in accordance with claim 1 further comprising a peel seal joining said bag front and rear walls.

5. The bag in accordance with claim 4 wherein said peel seal is positioned below said interlocking profiles.

6. The bag in accordance with claim 1 wherein at one side of said bag said front and rear walls are sealed to one another through said interlocking profiles.

7. The bag in accordance with claim 1 wherein at one side of said bag said front and rear walls are sealed to one another adjacent said interlocking profiles.

* * * * *